US006921072B2

(12) United States Patent
Hughes-Watts

(10) Patent No.: US 6,921,072 B2
(45) Date of Patent: Jul. 26, 2005

(54) BETTING ON A PLURALITY OF ROULETTE WHEELS

(76) Inventor: Julian Hughes-Watts, 261 Leahurst Road, Hither Green, London (GB), SE13 5LS ( * ) Notice: Subject to any disclaimer, the term of this patent is extended or adjusted under 35 U.S.C. 154(b) by 0 days.

(21) Appl. No.: 10/673,249

(22) Filed: Sep. 30, 2003

(65) Prior Publication Data

US 2004/0061285 A1 Apr. 1, 2004

Related U.S. Application Data

(60) Provisional application No. 60/414,664, filed on Oct. 1, 2002.

(30) Foreign Application Priority Data

Sep. 30, 2002 (GB) ..... 0222583

(51) Int. Cl.[7] ..... A63B 71/00
(52) U.S. Cl. ..... 273/142 E
(58) Field of Search ..... 273/142 E, 142 H, 273/142 HA, 142 J, 274; 463/17, 18

(56) References Cited

U.S. PATENT DOCUMENTS 1,578,412 A * 3/1926 Ewig ..... 273/142 E
5,636,838 A * 6/1997 Caro ..... 273/142 E
5,857,909 A * 1/1999 Rubin ..... 463/17
6,083,105 A * 7/2000 Ronin et al. ..... 463/17
6,209,869 B1 4/2001 Mathews
6,217,022 B1 * 4/2001 Astaneha ..... 273/138.1
6,227,542 B1 5/2001 Cosmi
6,352,260 B1 * 3/2002 Santiago ..... 273/274
6,497,409 B2 * 12/2002 Mathews ..... 273/142 E
6,561,512 B2 * 5/2003 Luciano et al. ..... 273/142 HA
6,575,834 B1 * 6/2003 Lindo ..... 463/40
6,659,462 B1 * 12/2003 Scott ..... 273/274
6,663,106 B1 * 12/2003 Cosmi ..... 273/142 E

FOREIGN PATENT DOCUMENTS

| | | |
|---|---|---|
| GB | 2 354 179 | 3/2001 |
| GB | 2 371 494 | 7/2002 |
| WO | WO 00/33269 | 6/2000 |

* cited by examiner

*Primary Examiner*—Kurt Fernstrom
(74) *Attorney, Agent, or Firm*—Young & Thompson

(57) ABSTRACT

A method and apparatus for allowing a player to place a bet on a plurality of roulette wheels that are spun substantially simultaneously. A betting area is associated with the plurality of roulette wheels and the player can select a subset of the roulette wheels upon which he wishes to place a bet. At least the selected subset of wheels are spun substantially simultaneously and the player is rewarded depending on the outcome of the bet placed.

10 Claims, 2 Drawing Sheets

BETTING ON A PLURALITY OF ROULETTE WHEELS

This application claims priority from U.S. Provisional Patent Application Ser. No. 60/414,664 filed on 1 Oct. 2002.

FIELD OF THE INVENTION

The present invention relates to betting on a plurality of roulette wheels.

BACKGROUND OF THE INVENTION

Conventional roulette games only allow players to place bets on a single wheel. Furthermore, the time taken for a result of a spin of a roulette wheel to become known is relatively long and this can cause players looking to play several games to become impatient.

GB 2371494 and WO 2000/033269 disclose modified roulette games including two separate wheels. In these games, the player is effectively limited to placing a single bet that covers one or both wheels. Further, the two wheels are spun sequentially. U.S. Pat. No. 6,227,542 describes a game having two concentric modified roulette-type wheels. Here, the player must place a bet on the outcome of spinning both wheels.

SUMMARY OF THE INVENTION

Embodiments of the present invention allow a player to place bets on a selected plurality of roulette wheels that are played substantially concurrently. This can shorten the period of time taken for a number of roulette wheel spin results to become known. As well as providing the facility to bet on each wheel as a separate betting entity, some embodiments give the player the option of making a bet on the combined results of spinning a multiplicity of roulette wheels.

According to a first aspect of the present invention there is provided a method of allowing a player to place a bet on a plurality of roulette wheels that are spun substantially simultaneously, the method including steps of:

providing a plurality of roulette wheels and a respective plurality of balls, each said wheel having a plurality of compartments;

providing a betting area associated with the plurality of roulette wheels;

allowing a player to select a subset of the roulette wheels upon which he wishes to place a bet;

allowing the player to use the betting area to bet on an outcome of spinning the selected subset of wheels;

spinning at least the selected subset of wheels substantially simultaneously such that each said ball comes to rest in a said compartment of its respective wheel, and rewarding the player depending on the outcome of the bet placed.

It will be understood that features such as "roulette wheel" and "balls" need not be conventional physical elements. Simulated or virtual wheels and balls are also covered, or any electronic or mechanical representation of roulette wheels or balls. Further, the roulette wheel need not be an exact replica of a traditional (American or European) roulette wheel. For example, the numbers and/or colours on the wheel could be arranged in a different manner; more or less slots/numbers could be included and/or the numbers could be replaced by symbols (e.g. fruit). Similarly, "spinning" can cover any arrangement (e.g. a graphical animation) where a number on a roulette wheel is selected in an at least apparently random manner.

The player may be required to select a subset including a minimum number, e.g. 2, of the wheels for the subset.

The step of allowing the player to bet on an outcome of spinning the selected subset of wheels typically involves the player selecting a compartment, or a set of compartments, in which he predicts the ball of one or more of the selected wheels will land when it comes to rest. In some embodiments, the player may specify which one of the wheels the ball will come to rest in the selected compartment(s).

The method may further include steps of:

allowing the player to use a betting area (which may be different to the main betting area) to select a compartment or a set of compartments which will be associated with all or some of the plurality of wheels;

determining whether a win state has occurred, a win state existing if for two or more wheels for which compartments have been selected, the respective ball lies in the selected compartment;

rewarding the player in accordance with the win state.

The rewarding step will normally depend upon the number of the player compartment selections that are correct.

Alternatively or additionally, the player may be awarded a bonus if he places a plurality of bets and more than one of these bets are winning bets.

The roulette wheels may begin spinning and/or come to rest substantially simultaneously.

According to another aspect of the invention there is provided gaming apparatus for allowing a player to bet on a plurality of roulette wheels, the apparatus including:

a plurality of roulette wheels and a respective plurality of balls, each said wheel having a plurality of compartments;

a selection device for allowing a player to select a subset of the roulette wheels upon which he wishes to place a bet;

a betting area associated with the plurality of roulette wheels, the betting area usable by the player to bet on an outcome of spinning the selected subset of wheels;

a device for determining whether a win state has occurred, a win state existing if for two or more wheels for which compartments have been selected, the respective ball lies in the selected compartment;

a rewarding device for rewarding the player in accordance with the win state.

At least the balls and/or the wheels may be simulated and shown on a display. The display may be remote from at least some of the devices, e.g. the game may be running on a computer communicating with a centralised gaming server over a communications network.

According to a further aspect of the present invention there is provided a method of allowing a player to place a bet on a plurality of roulette wheels, the method including steps of:

providing a plurality of roulette wheels and a respective plurality of balls, each said wheel having a plurality of compartments;

providing a betting area associated with the plurality of roulette wheels;

allowing the player to use the betting area to select a compartment or a set of compartments which will be associated with all or some of the plurality of wheels;

spinning at least the wheels for which the player has selected a compartment such that each said ball comes to rest in a compartment of its respective wheel;

determining a win state depending on how many balls of the wheels have come to rest in compartments corresponding to the selections made by the player for the wheels, and rewarding the player depending upon the win state. The win state will normally require a minimum number of the player selections to be correct. The selection of a said compartment will normally be made by indicating a corresponding number. The player may be able to select a compartment for each of the plurality of wheels. The roulette wheels may begin spinning and/or come to rest substantially simultaneously.

According to yet another aspect of the invention there is provided gaming apparatus for allowing a player to place a bet on a plurality of roulette wheels, the apparatus including:

a plurality of roulette wheels and a respective plurality of balls, each said wheel having a plurality of compartments;

a betting area associated with the plurality of roulette wheels for allowing the player to select a compartment or a set of compartments which will be associated with all or some of the plurality of wheels;

a device for spinning at least the wheels for which the player has selected a compartment such that each said ball comes to rest in a compartment of its respective wheel;

a device for determining a win state depending on how many balls of the wheels have come to rest in compartments corresponding to the selections made by the player for the wheels, and a rewarding device for rewarding the player depending upon the win state.

BRIEF DESCRIPTION OF THE DRAWINGS

The invention may be performed in various ways and, by of example only, embodiments thereof will now be described, reference being made to the accompanying drawings in which.

DETAILED DESCRIPTION OF THE DRAWINGS

Figure 1:
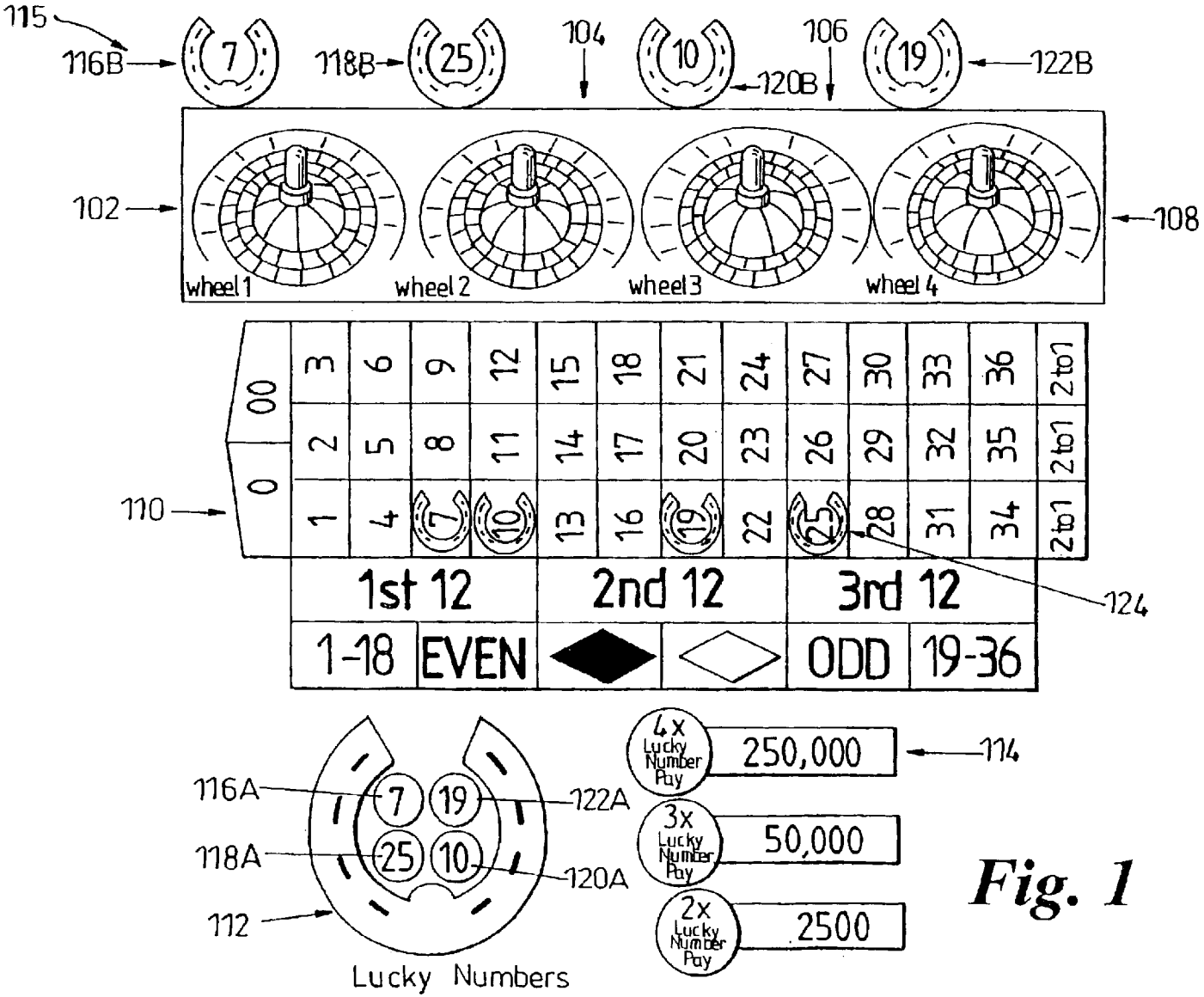
FIG. 1 illustrates a gaming area including plurality of roulette wheels and an associated betting area.

In FIG. 1 a gaming area includes four roulette wheels 102, 104, 106, 108. The four wheels are substantially conventional roulette wheels and are arranged in a row side by side. It will be understood that although four wheels are shown in the example, any reasonable number (over two) of roulette wheels can be used.

The gaming area also includes a betting area 110, which is substantially identical to a conventional roulette betting area. The gaming area further includes panels at locations 112, 114 and 115 that are associated with a "Lucky Numbers" feature described below.

During play, several elements of the game are substantially identical to those of conventional roulette. A major difference is that the player is allowed to select a certain number of the roulette wheels 102, 104, 106, 108 upon which his bet(s) is/are to be placed. A minimum number, e.g. 2 or 3, of the wheels may have to be selected. The way in which the player selects the wheel(s) depends upon the manner in which the game is implemented. For example, if the game is an electronic version then touch-screen technology can allow the player to select a wheel by touching its on-screen representation. Alternatively, electronic or mechanical buttons (e.g. colour-coded or numbered 1–4 to correspond with the four wheels) may be used. The selected wheel(s) may be highlighted or a marker may appear adjacent the wheel(s). If a physical set of wheels is being used then all or some of the wheel(s) can be selected by placing a marker adjacent the selected wheel(s).

The player can then select the number of a slot (or a set of slots) in which he predicts the ball(s) of any of the selected wheel(s) will come to rest after they have been spun. He can do this by placing a stake on a corresponding location of the betting area 110. As well as numbers corresponding to the numbered slots 0 to 36, the betting area 110 includes locations which the player can use to bet upon the ball stopping in a slot having any one of the numbers 1 to 12; 13 to 24; 25 to 36; 1 to 18; 19 to 36, or in a slot having an even number or an odd number, or in a slot having a number appearing on a red segment or a black segment of the roulette wheel. These types of bets are well known and will be familiar to roulette players, but it will be understood that alternative betting areas allowing players to make unconventional bets can also be used.

The player can make more than one selection of wheel(s) and/or bets. For example, he can make four bets, each one being based on a spin of one or more of the wheels 102, 104, 106, 108. If more than one player is participating then the further player(s) make their own wheel selection(s) and bet(s) in a similar manner. After all bets have been placed, the wheels 102, 104, 106, 108 are spun. The wheels can start spinning substantially simultaneously and the duration of all the spins may be substantially the same so that all the wheels come to rest with a ball in one of their numbered slots at or around the same time. If the ball(s) of any of the wheel(s) selected by the player stop in a slot having a number covered by a bet placed by the player then the player is rewarded his winnings, typically according to the rules of traditional roulette.

A player can also bet using the "Lucky Numbers" feature. This may happen automatically, e.g. when the player places a bet of an amount greater than a certain limit or if he selects a minimum number, e.g. four, of wheels. Alternatively, the player may be required to indicate that he wants to play the bonus feature by placing a stake on the panel 112 or by pressing an appropriate button. The "Lucky Numbers" feature can be considered to be a "side bet" placed alongside the main bet on the selected wheel(s), although it could be implemented as a main game.

The player can place a bet using the "Lucky Numbers" feature as follows. The Lucky Numbers panel 112 includes four areas 116A, 118A, 120A, 122A, each of which is associated with a respective one of the roulette wheels 102, 104, 106, 108. The player selects a "Lucky Number" corresponding to a compartment number for all or some of the roulette wheels. The player may be allowed to select a Lucky Number for a wheel even if he has not selected that wheel for his main bet. The number(s) selected will be indicated in the area(s) 116A, 118A, 120A, 122A in the panel 112, as well as in the corresponding area(s) 116B, 118B, 120B, 122B at location 115, adjacent the four wheels. Furthermore, an indication of a selected Lucky Number may be given on the betting area 110. For example, in FIG. 1 a "Lucky Number" bet has been indicated by a horseshoe shape 124 on number "25" on the betting area 110. This is the selected "Lucky Number" for wheel 104, and is further represented in the display areas 118A and 118B. It will be appreciated that variations of the Lucky Number selection can be implemented, e.g. the player may be able to choose a set of numbers rather than just one number for a wheel or may have to chose a single Lucky Number covering all or some of the wheels.

If the ball of a wheel stops in a slot having a number which the player has selected as a Lucky Number for that wheel then a Lucky Number bonus prize may be awarded. The Lucky Number bonus prize may be a certain amount of credits, or it may be some other form of reward, e.g. the win of the main bet being multiplied by a certain factor, or a free spin of all or some of the wheels. In some embodiments a Lucky Number bonus prize may only be awarded if a minimum number of Lucky Number wins occur. For example, in the example of FIG. 1, Lucky Number bonus prizes are awarded for 2, 3 or 4 Lucky Number wins, as shown by the "Lucky Pay" panels 114.

It will be understood that the "Lucky Numbers" feature is only one example of how having a plurality of roulette wheels can be used to enhance gameplay. In another embodiment, the player can (additionally) be awarded a bonus if he placed more than one bet on different wheels and more than one of the bets are winning bets.

It will be clear to the person skilled in the art that the gaming area shown in FIG. 1 could be implemented on a physical table, along substantially conventional roulette wheels, balls and chips, etc. Alternatively, the game could be implemented (at least partially) electronically with all or some of the elements of the gaming area of FIG. 1 appearing on a display on a screen. The display may include animated graphics simulating roulette wheels or could show a video recording or a video link to a real table having a plurality of roulette wheels. Touch screen technology or other types of well known user interfaces can be used to select wheels and make bets, etc.

Figure 2:
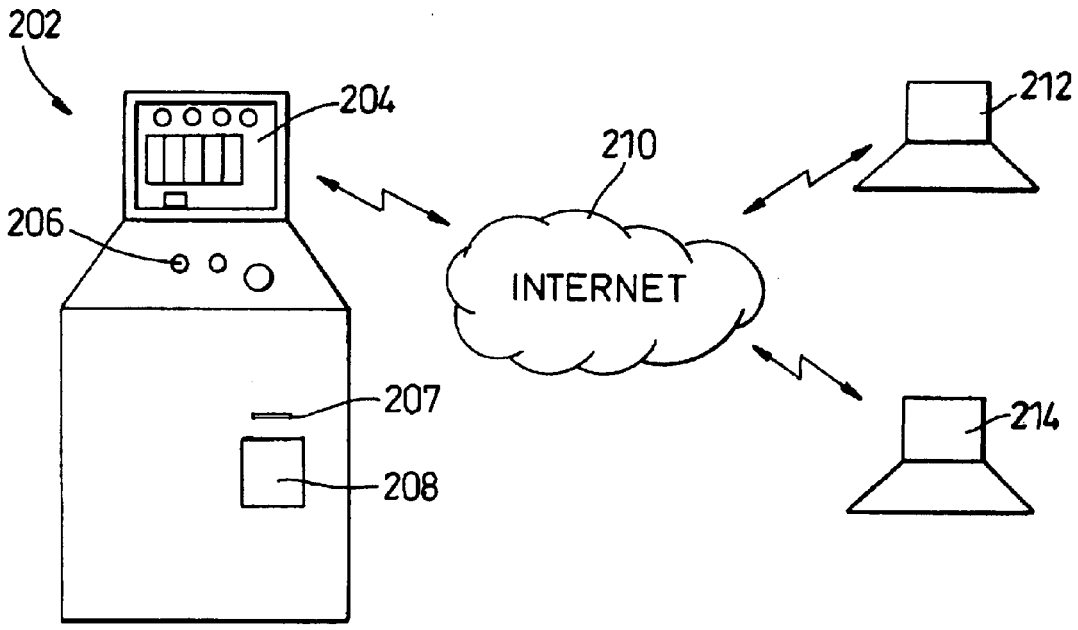
FIG. 2 illustrates schematically how the game may be implemented electronically.

FIG. 2 illustrates schematically an electronic gaming machine 202 having a display 204 that can configured to show the gaming area. The machine 202 further includes buttons 206, which the user can use to interact with the display instead of or in addition to a touch screen; a coin slot 207, for receiving credit, and a payout box 208 from which the player can collect his winnings.

In an alternative embodiment, the machine 202 is a computer apparatus that can communicate over a network 210 such as the Internet with remote terminals, e.g. PCs 212 and 214. Thus, several players can play the same game. Some or all of the players' bets may be displayed on all of the screens. Money could be bet using this embodiment by means of a credit card, etc.

I claim:

1. A method of allowing a player to place a bet on a plurality of roulette wheels that are spun substantially simultaneously, the method including steps of:

providing a plurality of roulette wheels and a respective plurality of balls, each said wheel having a plurality of compartments;

providing a betting area associated with the plurality of roulette wheels;

allowing a player to select a subset of the roulette wheels upon which he wishes to place a bet;

allowing the player to use the betting area to bet on an outcome of spinning the selected subset of wheels;

spinning at least the selected subset of wheels substantially simultaneously such that each said ball comes to rest in a said compartment of its respective wheel, rewarding the player depending on the outcome of the bet placed.

2. A method according to claim 1, wherein the player is required to select a minimum number of at least two of the wheels for the subset.

3. A method according to claim 1, wherein the step of allowing the player to bet on an outcome of spinning the selected subset of wheels involves the player selecting a compartment, or a set of compartments, in which he predicts the ball of one or more of the selected wheels will land when it comes to rest.

4. A method according to claim 1, wherein the player is awarded a bonus if he places a plurality of bets and more than one of the bets are winning bets.

5. A method according to claim 1, further including steps of:

allowing the player to use the betting area to select a further compartment or a further set of compartments to be associated with all or some of the plurality of wheels;

determining whether a further win state has occurred, the further win state existing if the balls of more than one of the spun wheels are resting in the further compartment or in one of the further set of compartments corresponding to the respective selections made by the player, and rewarding the player in accordance with the win state.

6. A method according to claim 1, wherein the step of allowing a player to select a subset of the roulette wheels upon which he wishes to place a bet comprises the step of the player identifying the specific wheel or wheels to be included in the subset.

7. Gaming apparatus for allowing a player to bet on a plurality of roulette wheels, the apparatus including:

a plurality of roulette wheels and a respective plurality of balls, each said wheel having a plurality of compartments;

a selection device for allowing a player to select a subset of the roulette wheels upon which he wishes to place a bet;

a betting area associated with the plurality of roulette wheels, the betting area usable by the player to bet on an outcome of spinning the selected subset of wheels;

a device for spinning at least the selected subset of wheels substantially simultaneously such that each said ball comes to rest in a said compartment of its respective wheel, a device for rewarding the player depending on the outcome of the bet placed, wherein said selection device for allowing a player to select a subset of the roulette wheels upon which he wishes to place a bet comprises a device for the player to identify the specific wheel or wheels to be included in the subset.

8. Apparatus according to claim 7, wherein at least the balls and/or the wheels are simulated and shown on a display.

9. Apparatus according to claim 7, wherein at least the balls and/or the wheels are simulated and shown on a display and at least the balls and/or the wheels are simulated and shown on a display and the display is remote from at least some of the devices.

10. A method of allowing a player to place a bet on plural roulette wheels using one betting area that is common to the plural roulette wheels, the method comprising steps of:

a player identifying a subset of at least two of the plural roulette wheels upon which he wishes to place a bet;

the player betting on an outcome of spinning the subset of the plural roulette wheels using the one betting area;

spinning the subset of the plural roulette wheels substantially simultaneously; and rewarding the player based on the outcome of the spinning.

* * * * *